US010471323B1

(12) United States Patent
Carlson et al.

(10) Patent No.: US 10,471,323 B1
(45) Date of Patent: Nov. 12, 2019

(54) PLAYING SURFACE ASSEMBLIES FOR SOFTBALL AND BASEBALL PITCHING AREAS

(71) Applicant: Sports Complex Design Group LLC, Everett, WA (US)

(72) Inventors: James E. Carlson, Marysville, WA (US); Joseph G. C. Adams, Jr., Wenatchee, WA (US); Frederick J. Schmidt, Jr., Everett, WA (US)

( * ) Notice: Subject to any disclaimer, the term of this patent is extended or adjusted under 35 U.S.C. 154(b) by 0 days.

(21) Appl. No.: 15/731,839

(22) Filed: Aug. 11, 2017

Related U.S. Application Data

(63) Continuation-in-part of application No. 14/545,647, filed on Jun. 1, 2015.

(60) Provisional application No. 61/997,408, filed on May 30, 2014.

(51) Int. Cl.

| | |
|---|---|
| ***A63B 71/00*** | (2006.01) |
| ***A63B 69/00*** | (2006.01) |
| ***A63B 71/02*** | (2006.01) |
| ***A63C 19/04*** | (2006.01) |
| *A63B 102/18* | (2015.01) |

(52) U.S. Cl.
CPC ..... *A63B 69/0013* (2013.01); *A63B 71/02* (2013.01); *A63C 19/04* (2013.01); *A63B 2069/0006* (2013.01); *A63B 2102/182* (2015.10)

(58) Field of Classification Search
CPC . A63B 69/0013; A63C 19/02; A63C 2203/10; A63C 19/12; A01G 9/00; E02D 29/14
USPC ..... 473/497, 499, 451, 438, 504; 52/19, 20; 49/57, 465; 404/26
See application file for complete search history.

(56) References Cited

U.S. PATENT DOCUMENTS

| | | | | | |
|---|---|---|---|---|---|
| 2,515,847 | A | * | 7/1950 | Winkler | E01C 13/08 473/171 |
| 3,108,804 | A | * | 10/1963 | Wagner | A63C 19/12 242/390.7 |
| 4,662,777 | A | * | 5/1987 | Newton | E02D 29/124 404/25 |
| 5,156,398 | A | * | 10/1992 | Kibamoto | A63B 69/3661 473/278 |
| 5,309,846 | A | * | 5/1994 | Peterson | E01C 13/083 108/53.3 |
| RE35,006 | E | * | 8/1995 | Ripley, Sr. | A63C 19/00 47/65.9 |
| 5,467,555 | A | * | 11/1995 | Ripley, Sr. | E01C 13/083 220/7 |

(Continued)

FOREIGN PATENT DOCUMENTS

| | | | | |
|---|---|---|---|---|
| GB | 2188964 | A * | 10/1987 | A01G 9/02 |
| GB | 2211528 | A * | 7/1989 | E02D 29/14 |

(Continued)

*Primary Examiner* — Mitra Aryanpour

(57) ABSTRACT

A replaceable wear insert assembly for playing surfaces in pitching areas and other high-wear areas of baseball and softball fields and other playing fields. A recess member is permanently or semi-permanently installable in a selected area of the field, such as a pitching lane. The recess member accommodates a replaceable insert member having an upper surface with a layer of synthetic turf or track material, mounted to rigid panel. The insert member is removable from the recess member so as to replaceable when worn.

4 Claims, 14 Drawing Sheets

(56) References Cited

U.S. PATENT DOCUMENTS 5,595,021 A * 1/1997 Ripley, Sr. ..... E01C 13/083 47/66.5
5,673,513 A * 10/1997 Casimaty ..... B65D 19/38 47/65.9
5,820,497 A * 10/1998 Pena ..... A63B 63/004 473/471
6,263,616 B1 * 7/2001 Hummer ..... A01G 9/033 47/65.9
6,732,666 B2 * 5/2004 Layt ..... A01G 9/02 111/105
6,846,253 B1 * 1/2005 Szwalek ..... A63B 63/004 473/422
7,070,511 B2 * 7/2006 Gustine ..... A63B 69/3661 473/163
7,845,113 B2 * 12/2010 Casimaty ..... A63C 19/00 47/65.9
D637,318 S * 5/2011 Sawyer ..... D25/156
7,958,669 B2 * 6/2011 Casimaty ..... A63C 19/00 47/1.01 F
9,120,004 B2 * 9/2015 Saltveit ..... A63C 19/12 52/6
10,212,894 B2 * 2/2019 Buist ..... A01G 9/033 47/65.6
2004/0081771 A1 * 4/2004 Waterford ..... E01C 13/08 428/17
2004/0177578 A1 * 9/2004 Casimaty ..... A63C 19/00 52/384
2005/0102921 A1 * 5/2005 Mischo ..... A01G 9/033 52/79.1
2011/0030274 A1 * 2/2011 Buist ..... A01G 9/033 47/65.6
2017/0215344 A1 * 8/2017 Meyer ..... A01G 25/00 47/65.9

FOREIGN PATENT DOCUMENTS

GB 2188964 B * 7/1990 ..... A01G 9/02
GB 2250307 A * 6/1992 ..... A01G 9/00
GB 2265649 A * 10/1993 ..... E02D 29/14
GB 2320736 B * 11/1998 ..... E02D 29/14
GB 2359839 A * 9/2001 ..... E02D 29/14
GB 2483019 B * 6/2012 ..... E02D 29/14
JP 09177107 A * 7/1997 ..... E02D 29/14
WO WO 9101412 A1 * 2/1991 ..... A01G 9/00

* cited by examiner

PLAYING SURFACE ASSEMBLIES FOR SOFTBALL AND BASEBALL PITCHING AREAS

RELATED CASES

This application is a continuation-in-part of Nonprovisional patent application Ser. No. 14/545,647, filed Jun. 1, 2015, now pending, which application claims the benefit of Provisional Patent Application Ser. No. 61/997,408 filed May 30, 2014.

BACKGROUND a. Field of the Invention

The present invention relates generally to playing surfaces for athletic fields and similar facilities, and, more particularly, to a playing surface assembly for use in pitching areas of softball and baseball fields and similar high-use areas of athletic fields having a wear surface that retain its shape with repeated use and that are replaceable when worn.

b. Related Art

While some modern athletic fields retain natural surfacing the form of natural grass turf and dirt/clay, a great many now employ artificial turf surfaces in which a layer of synthetic turf is installed over soil or other substrate. Artificial turf provides obvious advantages in terms of maintenance, durability and the capability of being used outdoors or indoors and regardless of growing conditions. A particular group of athletic fields in which artificial turf is commonly installed over the whole or a part of the playing surface are softball and baseball fields.

Softball and baseball pitchers employ a wide range of techniques, but virtually all involve using the legs and feet in one manner or another. Moreover, the various steps, strides and so on take place repeatedly, many times during practice or a game, within the same small, usually confined area of the surface of the field, with the result that this particular area typically experiences an exceptional amount of wear and damage. Where the field surface is formed of a layer of artificial turf, the conventional remedy to such wear and damage has been to cut out the worn area and replace it with a "patch" of the same turf material; not unlike installing a "patch" in one's living room carpet, the result is typically both unsightly and more susceptible to damage than the original. The integrity and appearance of the turf surface of the entire field is thus compromised by damage that is confined to certain relatively small high-wear areas.

The foregoing problem is particularly notable in the case of fast pitch softball, where much of the force of the pitch is generated by a leg drive in which the player thrusts one leg and foot forward while dragging the other. These motions take place within a narrow (e.g., 2-3 feet) "lane" within the pitching circle of the softball diamond, such that this area experiences very significant abrasion and impact loading. In "skinned" fields this area may be formed of dirt or clay that can be smoothed back out at some later time, but which rapidly becomes cratered and furrowed during play or practice and often creates significant difficulties for pitchers as the game proceeds. Installations using artificial turf or similar coverings in this area avoid the problem of the dirt becoming uneven in the pitchers lane, however, the concentrated wear leads to early damage and greatly accelerates the need to patch the field, at significant cost and with the negative consequences described above.

Accordingly, there exists a need for an apparatus for the pitching areas of softball and baseball fields or similar high-wear areas of these or other athletic fields that presents a playing surface that remains substantially even and consistent during use. Furthermore, there exists a need for such an apparatus that reduces the frequency at which the surface needs to be replaced or restored in these areas. Still further, there exists a need for such an apparatus in which the surface can be replaced when worn without creating a weak and unsightly repair as is the case with conventional patching techniques.

SUMMARY OF THE INVENTION

The present invention addresses the problems cited above, and is an assembly having a replaceable wear surface that is set within the surrounding playing surface of a softball or baseball field.

In a broad aspect, the invention provides an apparatus comprising a recess member having an interior and an upper opening, that is set within a selected wear area of a playing field, and an insert member that is removably set within the opening of the recess member and that has a thickness such that an upper surface of said insert member lies substantially level with the surrounding surface of the playing field, the upper surface of the insert member comprising a playing surface resistant to wear and damage by the player's feet. The selected wear area of a playing field may be a pitching area of a softball or baseball field.

The playing surface of the insert member may comprise a layer of synthetic turf or wear-resistant synthetic track material, for example. The insert member may be invertible within the recess member and may comprise first and second playing surfaces on opposite sides thereof. The insert member may be removable and replaceable with a new insert member when the playing surfaces become worn.

The recess member may comprise a recess that receives the insert member, and a horizontal flange portion that extends outwardly from sides of the tray portion for mounting of a replaceable border portion formed by synthetic playing surface material.

The insert member comprises a generally flat, rectangular member dimensioned to correspond generally to a defined lane of the pitching area. The recess portion of the recess member may comprise a generally horizontal lower interior surface that engages a downwardly disposed surface of the insert member so as to support the insert member horizontally in the recess member.

The recess member may further comprise an outer tray member that receives the recess member and insert member. The tray member may comprise an upstanding lip portion that forms a boundary between the border portion on the recess member and the surrounding surface of the field to exclude dirt and debris from entering the recess member.

These and other features and advantages of the present invention will be more fully appreciated from a reading of the following detailed description with reference to the accompanying drawings.

DETAILED DESCRIPTION

In many of the drawings, elements are designated with a reference number followed by a letter, e.g., "168*a*, 168*b*." In such cases, the letter designation is used where it may be useful in the corresponding description to refer to or differentiate between specific ones of a number of otherwise similar or identical elements. Where the description omits the letter from a reference and refers to such elements by number only, this can be understood as a general reference to the elements identified by that reference number, unless other distinguishing language is used.

Typically, games that are played by teams of players competing physically on a playing field require some minimum field size to accommodate the players and permit and encompass acceptable boundaries of play, in accordance with the rules of the particular game. For example, baseball and softball are both played on a field that includes a "diamond" comprising four bases and foul lines extending from home base outward along first and third liens, although in the case of informal and "pick-up" games, the precise dimensions and shape of the diamond can vary from what might be considered "regulation" and lines defining the boundaries of play may not be explicitly marked on the field. Nevertheless, it is well understood that reference to a "ball field" is to the entire field of play, rather than limited portions thereof.

Similarly, as used in the present specification and claims the term "playing field" refers to the entirety of a field of play, i.e., a space sufficient for teams of players to compete in accordance with mutually accepted rules of competition.

The present invention provides an assembly including a removable insert having a wear resistant surface that is installable in selected area of playing fields, such as pitching areas of softball or baseball playing fields. Preferred embodiments of the invention are described herein in the context of softball and baseball pitching lanes located within the field of play, however, it will be understood that some embodiments may be installed and configured for installation in other areas, such as batter boxes or pitching or batting practice areas, for example, or in areas of other types of playing fields.

Figure 1:
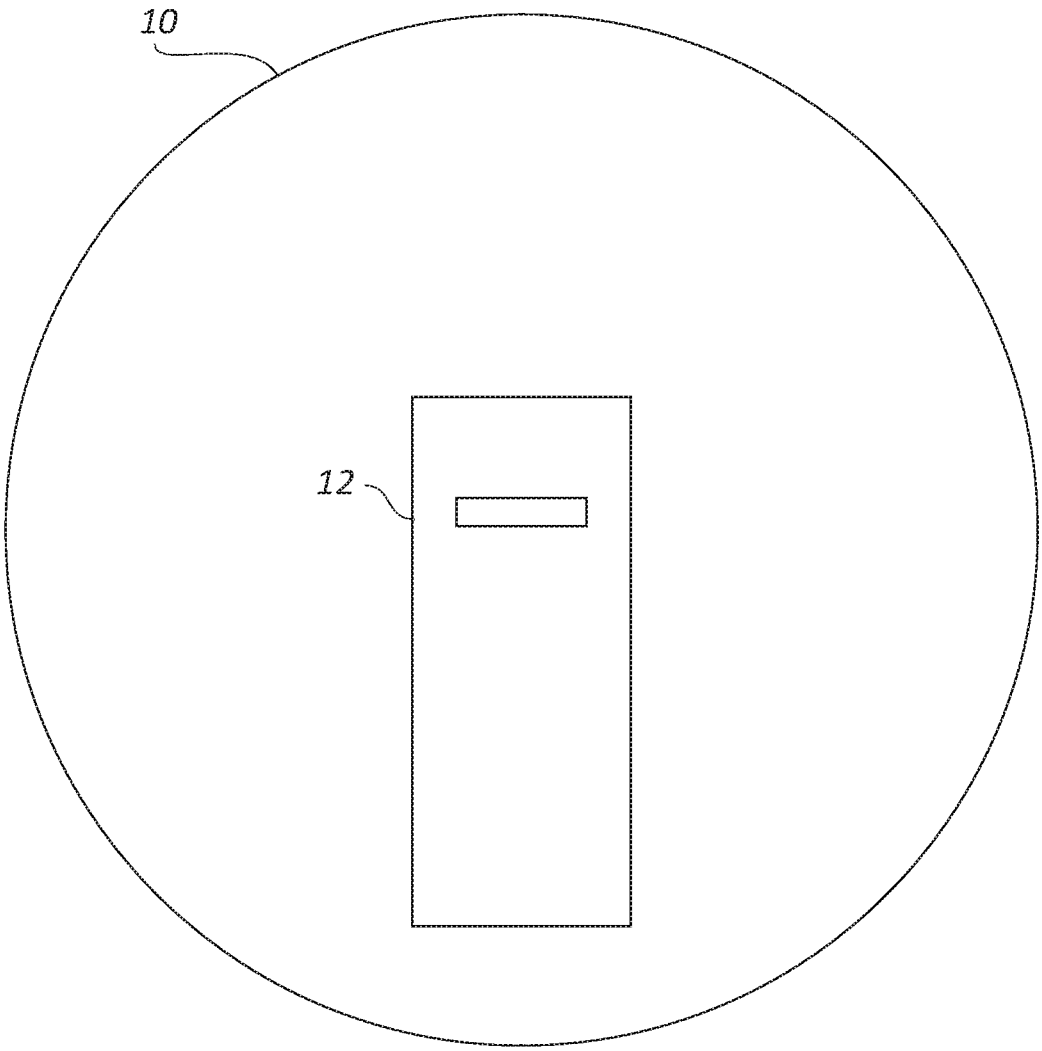
FIG. 1 is a diagrammatic view of a pitching circle of an exemplary fast pitch softball field having a wear surface insert assembly in accordance with the present invention set therein.
Figure 2:
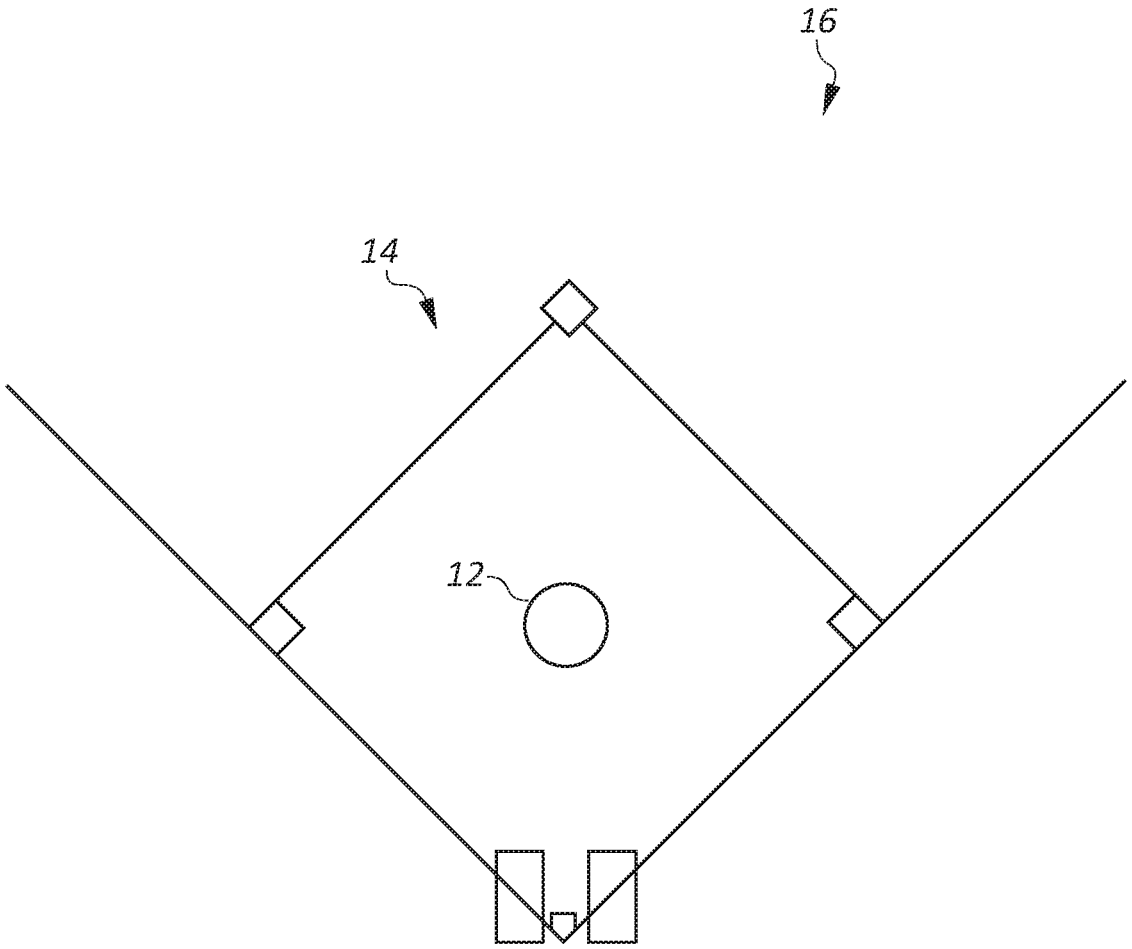
FIG. 2 is a diagrammatic view of the diamond area of an exemplary fast pitch softball field, showing the location of the pitching circle of FIG. 1 therein.

FIG. 1 thus shows an example location for an insert assembly 10 in accordance with a first preferred embodiment of the present invention, within a conventional pitcher's circle 12 of a fast-pitch softball field. FIG. 2, in turn, shows the location of the pitcher's circle within the diamond 14 and relative to the other areas of the playing field 16.

Figure 3:
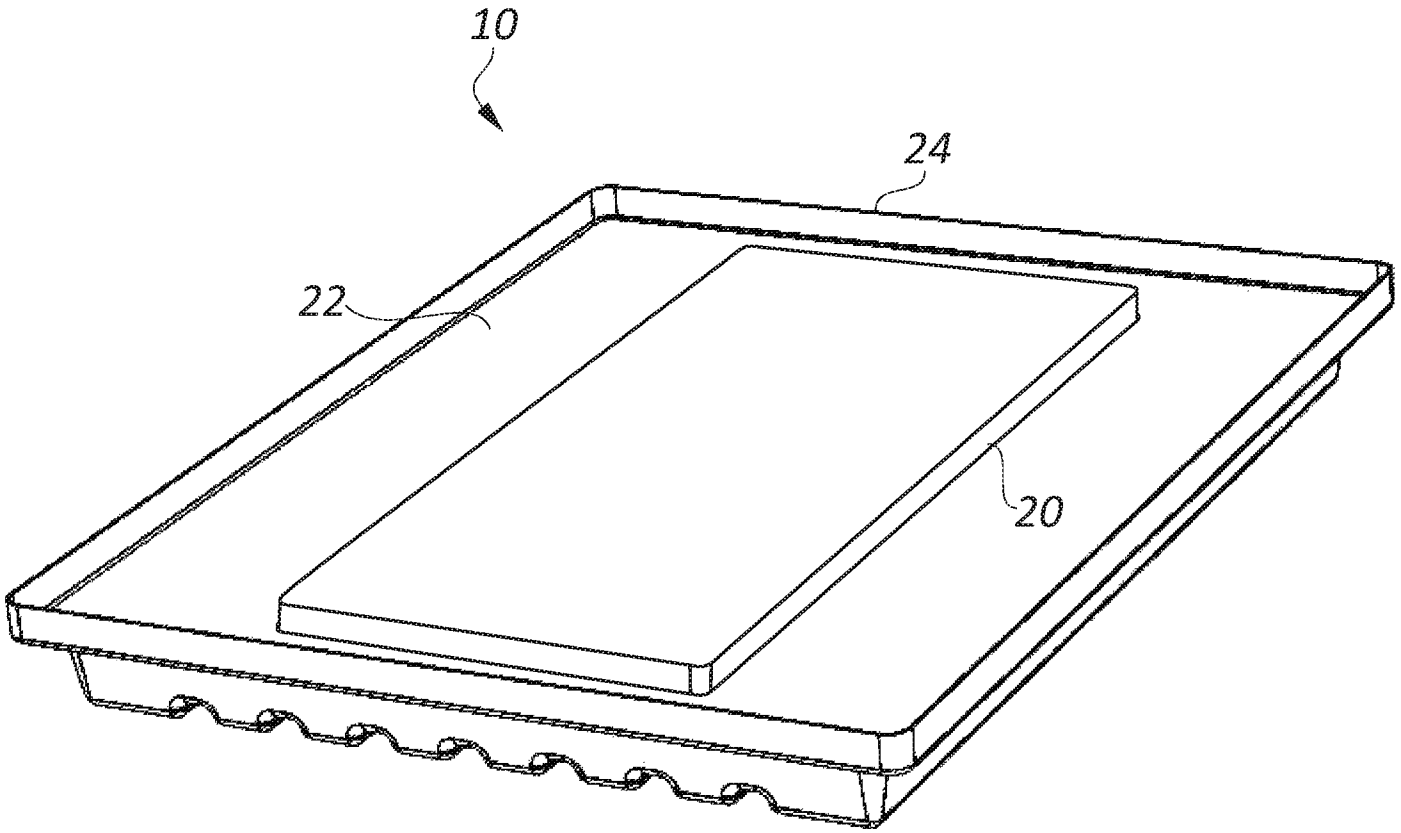
FIG. 3 is a perspective, partially ghosted view of the wear surface insert assembly of FIG. 1, showing the insert, recess members and outer tray members thereof.
Figure 4:
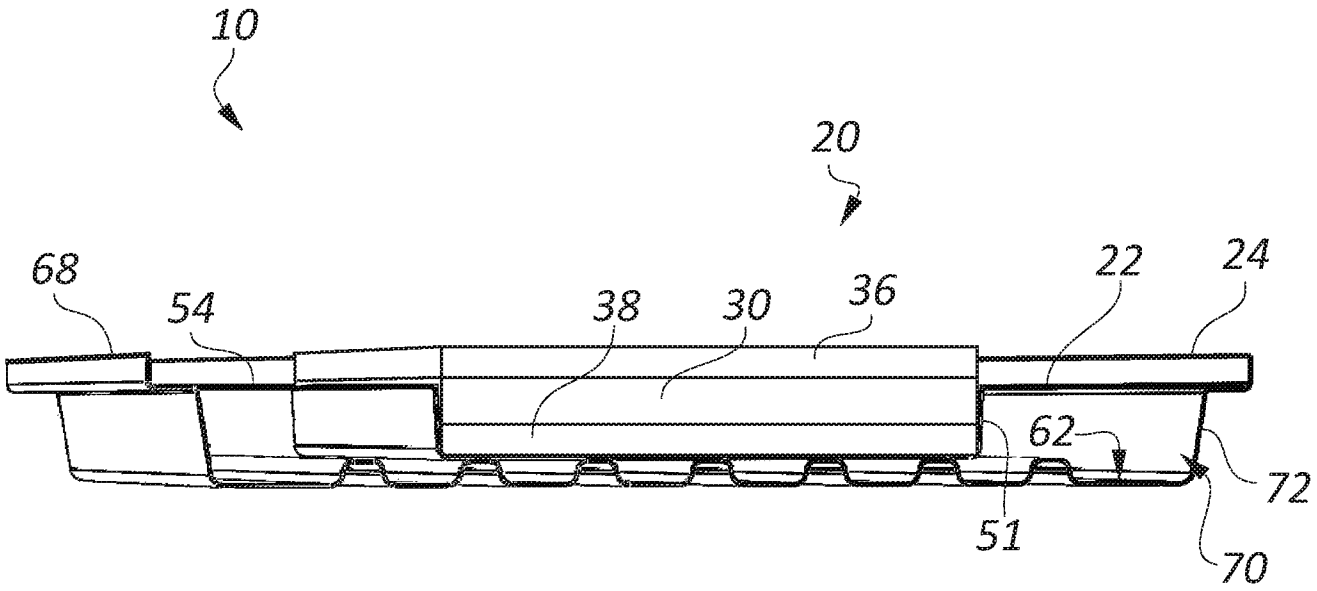
FIG. 4 is a side elevational, partially ghosted view of the insert assembly of FIG. 3, showing in greater detail the relationship of the components thereof.

As can be seen in FIGS. 3-4, the assembly 10 includes three principal members, namely, a removable insert member 20, a recess member 22 having a depression that holds the insert member, and an outer tray member 24. In the illustrated embodiment the insert assembly is in the form of an elongate rectangle in plan view, so as to correspond to a defined pitcher's lane of a conventional fast pitch softball field, however, it will be understood that other shapes may be employed depending on the installation type and other design factors; it will also be understood that the dimensions of the illustrated embodiment contained herein are provided by way of illustration rather than limitation.

As can be seen in FIGS. 5A-5D, the main structural component of the removable insert member 20 is a comparatively thin, rigid panel 30 that is shaped and dimensioned to fit within the opening of the recess member 22. The panel includes generally flat, parallel surfaces 32, 34, one or the other one of which will be disposed upwardly when the insert member is placed in the recess member in the field. In the illustrated embodiment, layers 36, 38 of synthetic playing surface material (see FIG. 8) are adhered or otherwise mounted to the surfaces 32, 34 of the panel. However, it will be understood that in some embodiments the playing surfaces may be formed as part of or integrally with the surfaces of the panel itself. The layers 36, 38 in the illustrated embodiment may suitably be formed of synthetic turf or synthetic track material (e.g., polymeric track surfacing), that may be removed and replaced with fresh layers of material when worn. Moreover, the surface material on one side of the insert member may be of a first type selected for purposes of softball/baseball use, while the material on the other side may be of a second type selected for a different use, e.g., soccer or football; in this instance the field may be converted from one use to the other by simply flipping over the insert member of the assembly.

Rigid panel 30 is constructed or otherwise formed to be resistant to both compression and bending/bowing when subjected to edgewise loading. Moreover, as can be seen, the perimeter of the panel member is configured to fit closely within the confines of the depression of the recess member, so that there is minimal end-to-end and side-to-side clearance between the two. Abutment between the panel and the walls of the recess thus arrest and limits movement of the insert member within the recess member, holding the former against shifting when it is subjected to front-to-rear and side-to-side forces by the feet of the pitcher on its upper surface. Moreover, the rigidity of the panel prevents the insert member from bending, bowing or buckling under the loads, so that the insert member forms a stable surface that remains fixed in position and stable in configuration during play.

Figure 5B:
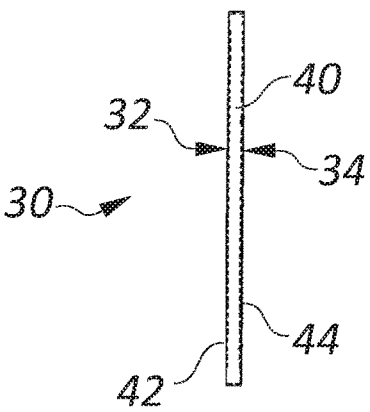
FIGS. 5A-5D are, respectively, plan, end elevational, side elevational and edge detail views of the playing surface insert member of the assembly of FIGS. 3-4.
Figure 5D:
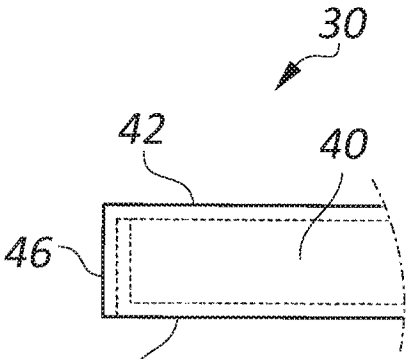
Figure 5A:
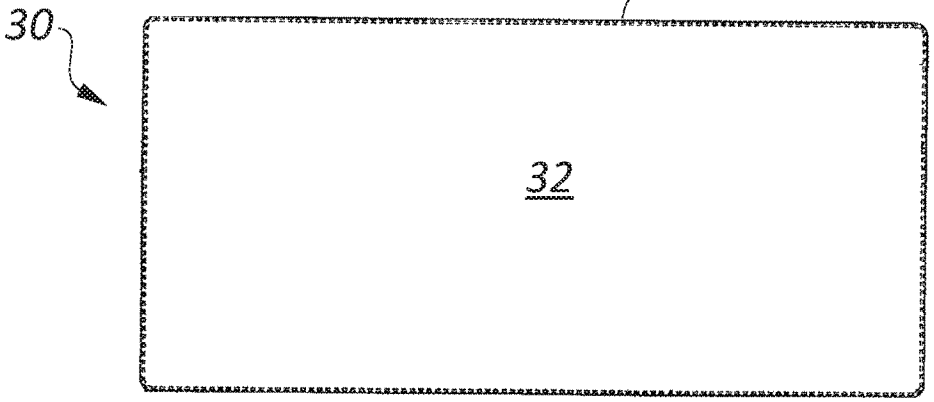
Figure 5C:
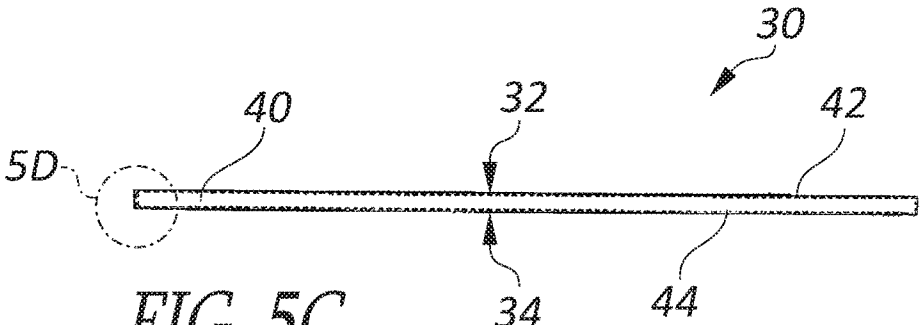
Figure 6C:
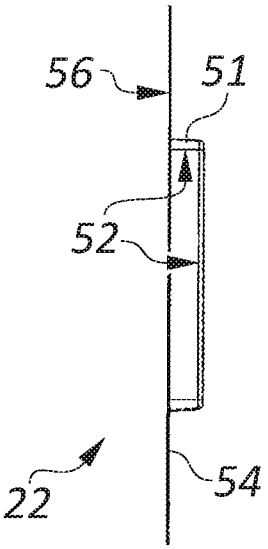
FIGS. 6A-6D are, respectively perspective, plan, end elevational and side elevational views of the recess member of the assembly of FIGS. 3-4.
Figure 6A:
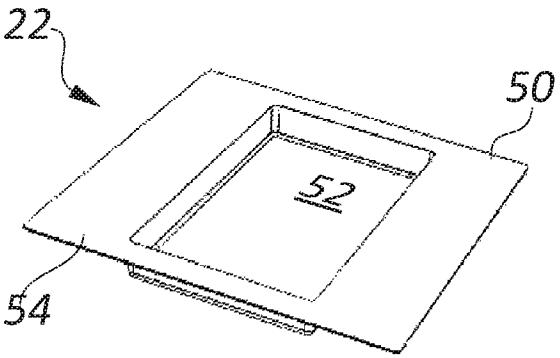
Figure 6B:
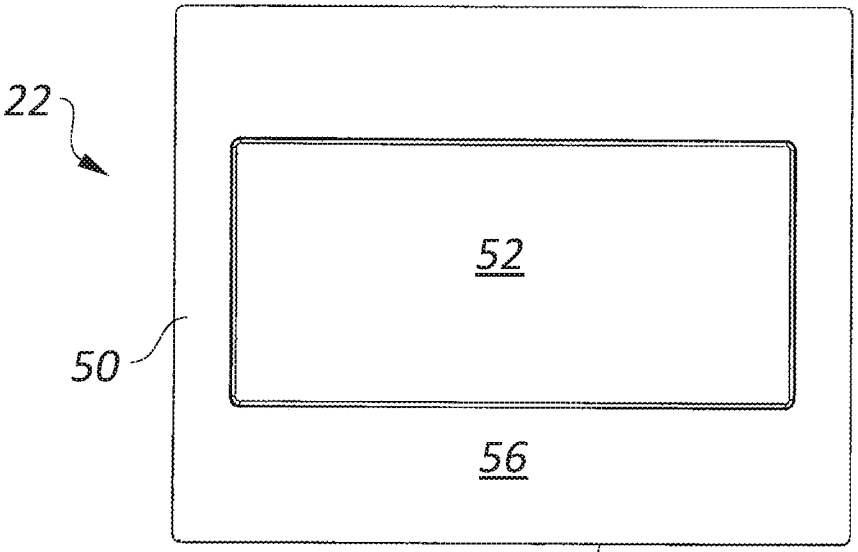
Figure 6D:
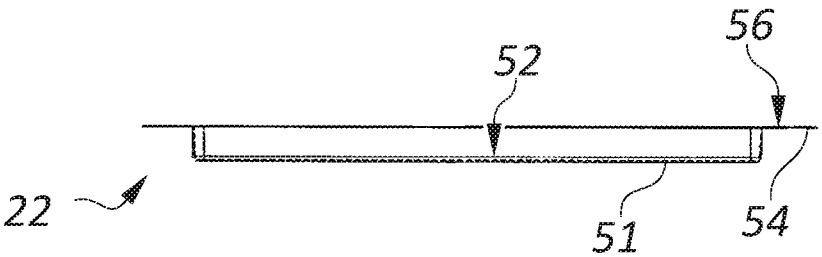
Figure 7A:
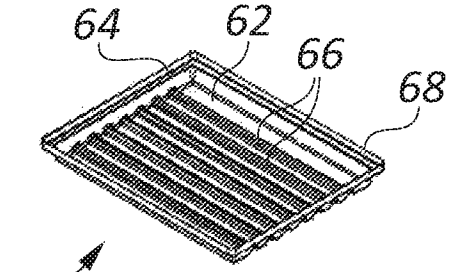
FIGS. 7A-7E are, respectively, perspective, plan, end elevational, side elevational and edge detail views of the outer tray member of the assembly of FIGS. 3-4.
Figure 7C:
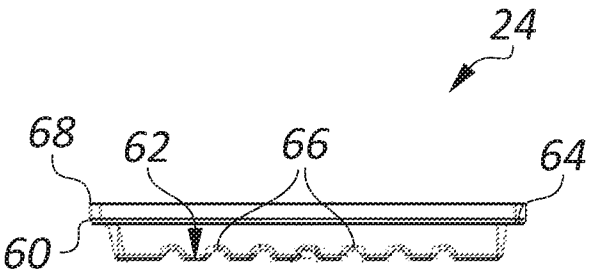
Figure 7B:
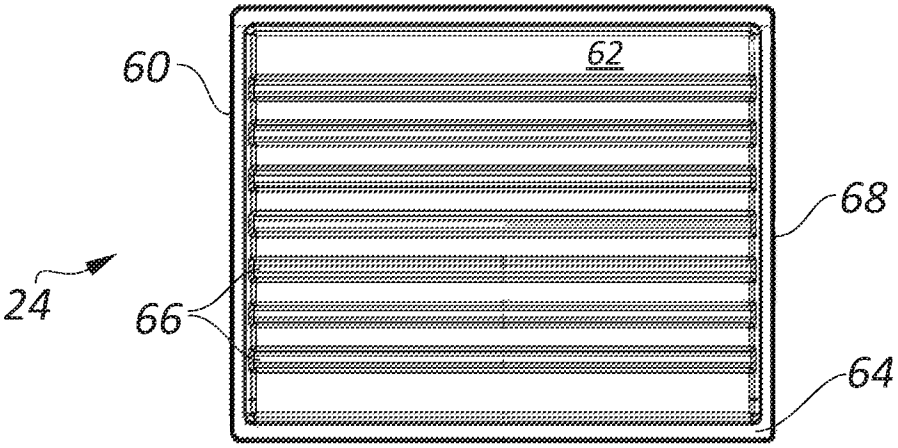
Figure 7D:
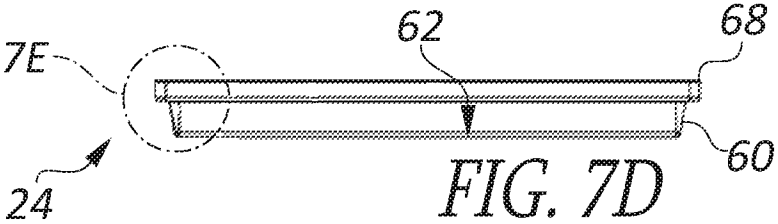
Figure 7E:
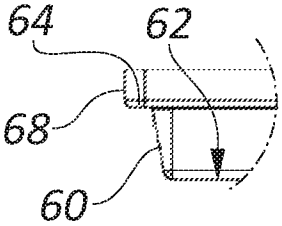

As can be seen with further reference to FIGS. 5B-D, panel 30 may be formed as a lightweight structure having a foam filled core 40 sandwiched between hard top and bottom shells 42, 44, the shells overlapping to form a double thickness edge 46 about the perimeter 48 of the panel for added durability and resistance to damage.

FIGS. 6A-6D in turn show the recess member 22 of the assembly. As can be seen, the recess member 22 includes a somewhat flat, panel-like body 50, suitably formed of a sheet of rigid plastic material such as ABS, for example. A depression 51 generally in the middle portion of the sheet forms a recess 52 that is shaped and dimensioned to receive the insert member 20 in close fitting yet removable engagement therein, with minimal gap about the perimeter of the insert member. A horizontal flange portion 54 extends outwardly about the perimeter of the recess 52 and provides an upper surface 56 on which a border of synthetic turf or other surface material may be installed, as described in greater detail below.

As can be seen in FIGS. 7A-7E, the outer tray member 24 in turn includes a body 60 that again may be formed of a thin, rigid material, such as ABS plastic, for example. A depression in the middle area of the body forms a recess 62 that is dimensioned to receive the downwardly projecting lower side of the recess member 22, with a flange 64 about the perimeter of recess 62 in turn providing support for the corresponding flange 54 on the recess member. In the illustrated embodiment, the bottom wall of the tray member includes a series of raised ribs 66 upon which the bottom of the recess member rests, however the principal purpose of the ribs is to impart rigidity to the bottom wall and consequently they may not be included in some embodiments. An upstanding wall forms a vertically-extending lip 68 that forms a boundary between the border material of the assembly and the surface material of the surrounding field.

As can be seen with further reference to FIG. 4 (see, also, FIG. 8), the edge of the perimeter flange 54 fits closely within the upstanding lip 68 of the outer shell member 24, allowing the recess member 22 to be set within the shell member, with recess 62 accommodating the depression 51 of the former. The cavity 70 between the sides of the depression 51 and the side wall 72 of the outer shell are filled with structural foam or other suitable, preferably lightweight fill material, joining the two members 22, 24 together in a lightweight yet durable unit that holds or "catches" the insert member 20 in the manner described above.

Figure 8:
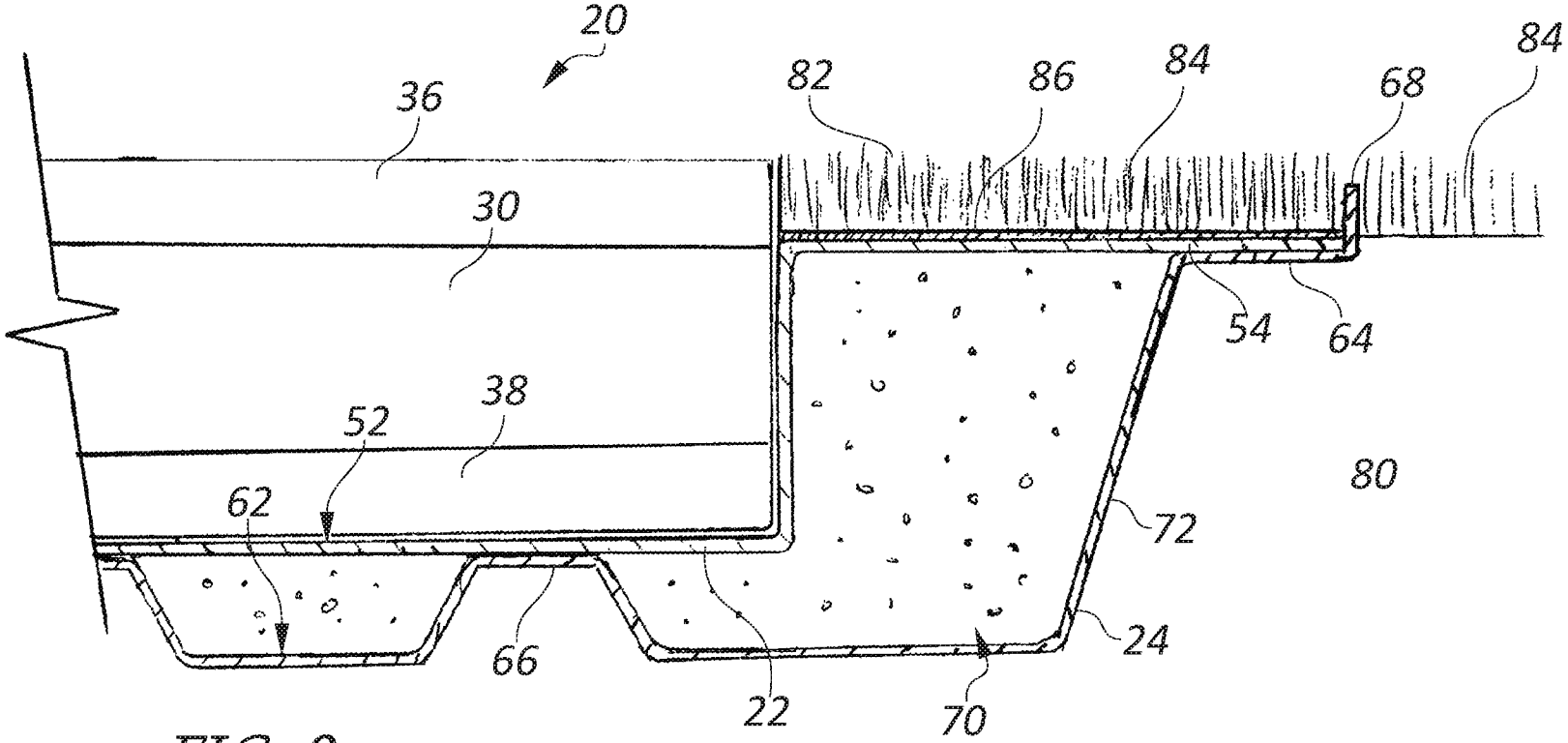
FIG. 8 is a partial cross-sectional view of an exemplary installation of the tray assembly of FIGS. 3-4, showing the manner in which the horizontal flange portion of the recess member has a border strip of synthetic surface material installed thereon and the upstanding edge of the tray member forms a boundary between the border strip and the surface material of the surrounding field.

FIG. 8 shows an exemplary installation, with the combined recess and tray members set within an excavation or other recess in the substrate 80 of the playing field and the invertible insert member 20 positioned within recess 52. As can be seen, the upper side of the insert member is thus positioned generally level with that of the surrounding field; in the illustrated embodiment, the upper layer 36 of the insert member may be formed of a synthetic turf material and therefore set with the upper level of the turf level with that of the surrounding turf, whereas in other embodiments the layer surface on the insert may be formed of a shorter, harder materials such as elastomeric track surfacing and therefore set somewhat lower than the surrounding turf.

As noted above, a border 82, formed for example of a synthetic turf material 84, may be installed atop the perimeter flange 54 of the recess member, using a layer of adhesive material 86 or hook-and-loop fabric or other material, allowing the border to be removed when worn and replaced with fresh turf or other surface material. The upstanding lip 68 on the outer tray in turn forms a boundary between the border material 82 and turf or other surface material 84 of the surrounding field, providing a neat edge between the two and also excluding dirt/debris from entering and falling into recess 52.

Figure 9:
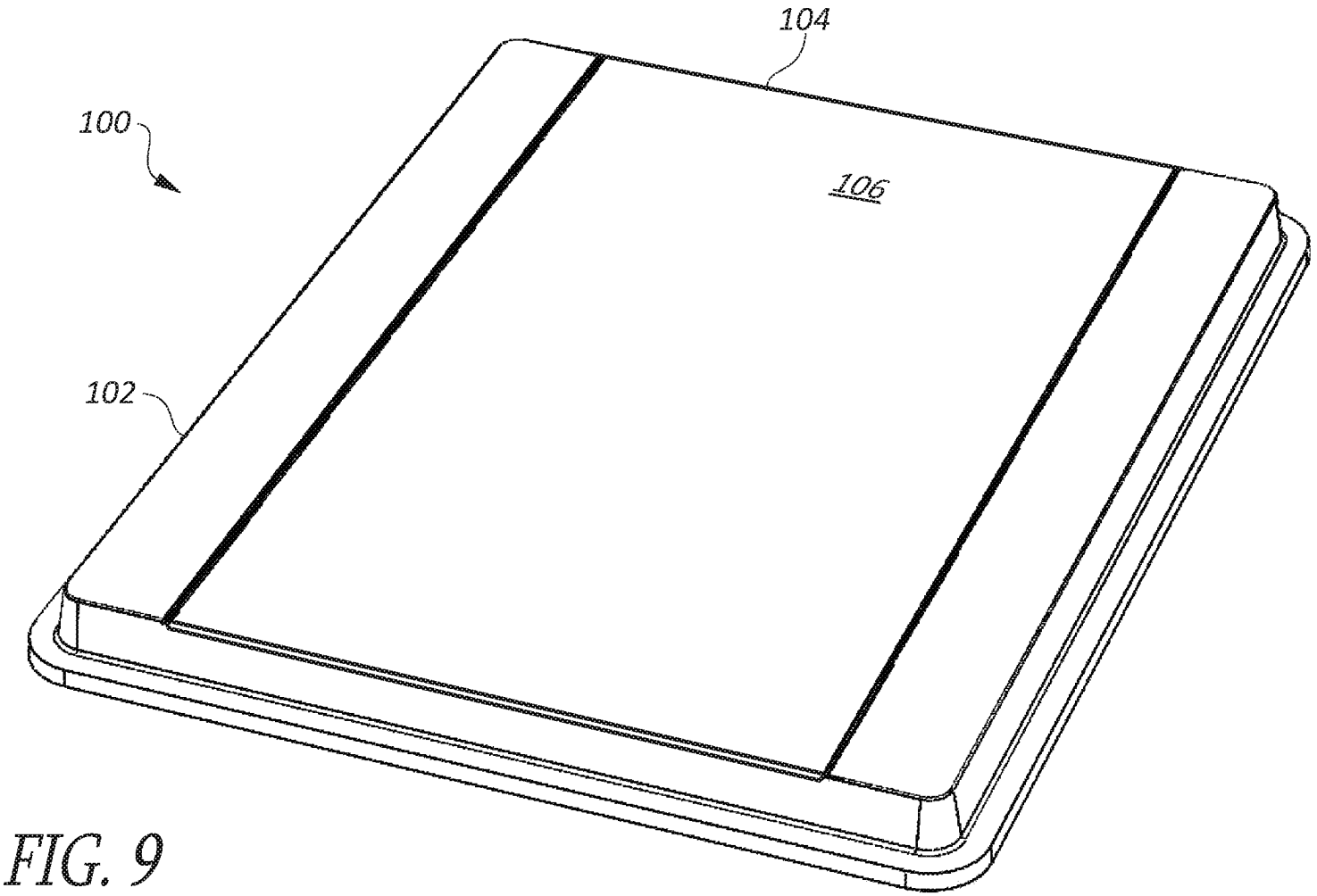
FIG. 9 is a perspective view of a wear insert assembly in accordance with another embodiment of the invention, in which the recess member includes a base that is set within the field to anchor the assembly and a relatively shallow recess that receives the panel-shaped insert member.
Figure 10:
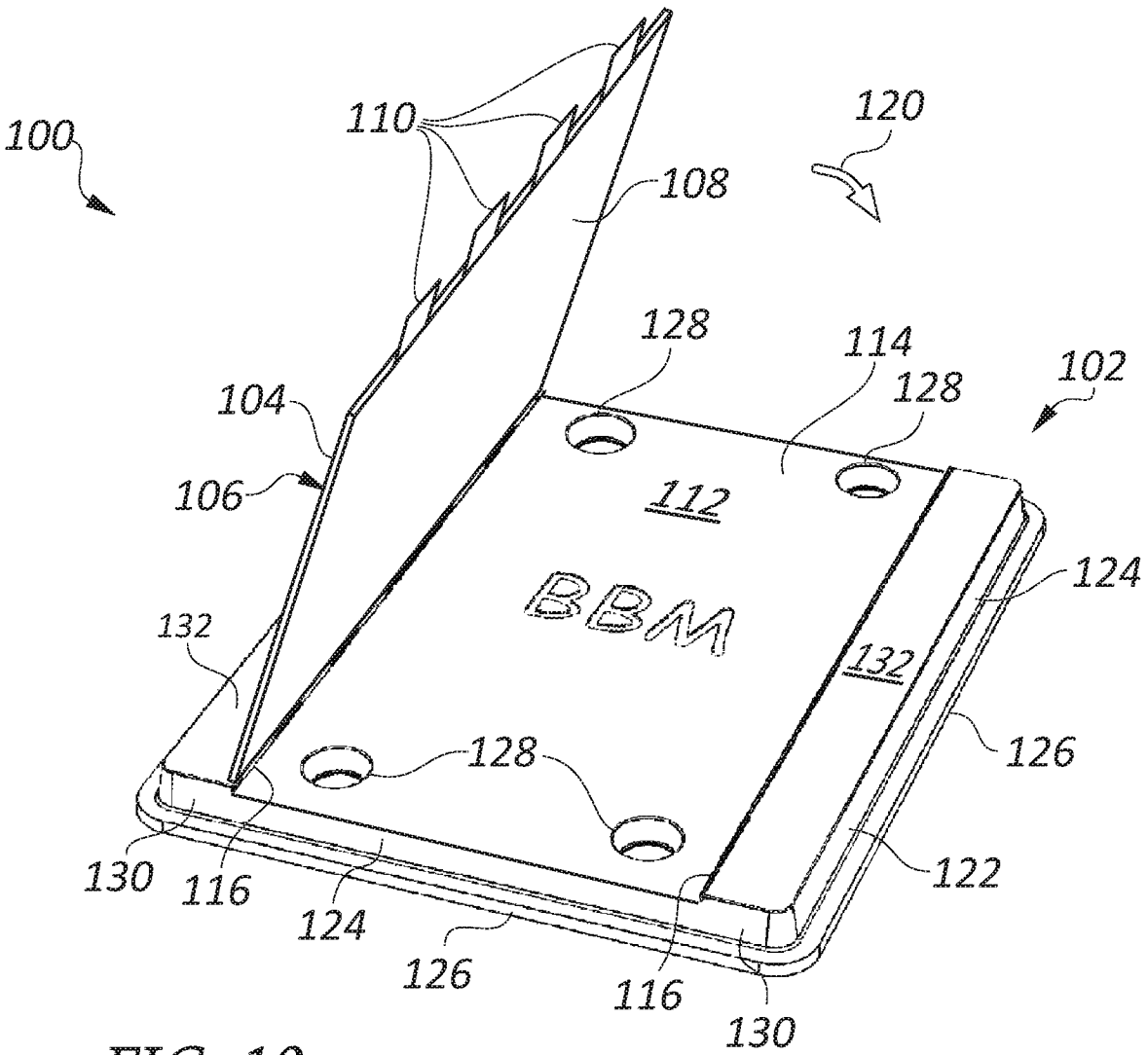
FIG. 10 is a perspective view of the wear surface assembly of FIG. 9, with the replaceable insert member partially removed and lifted to show the recess area and pour holes through which concrete is poured into the base to anchor the assembly.
Figure 11:
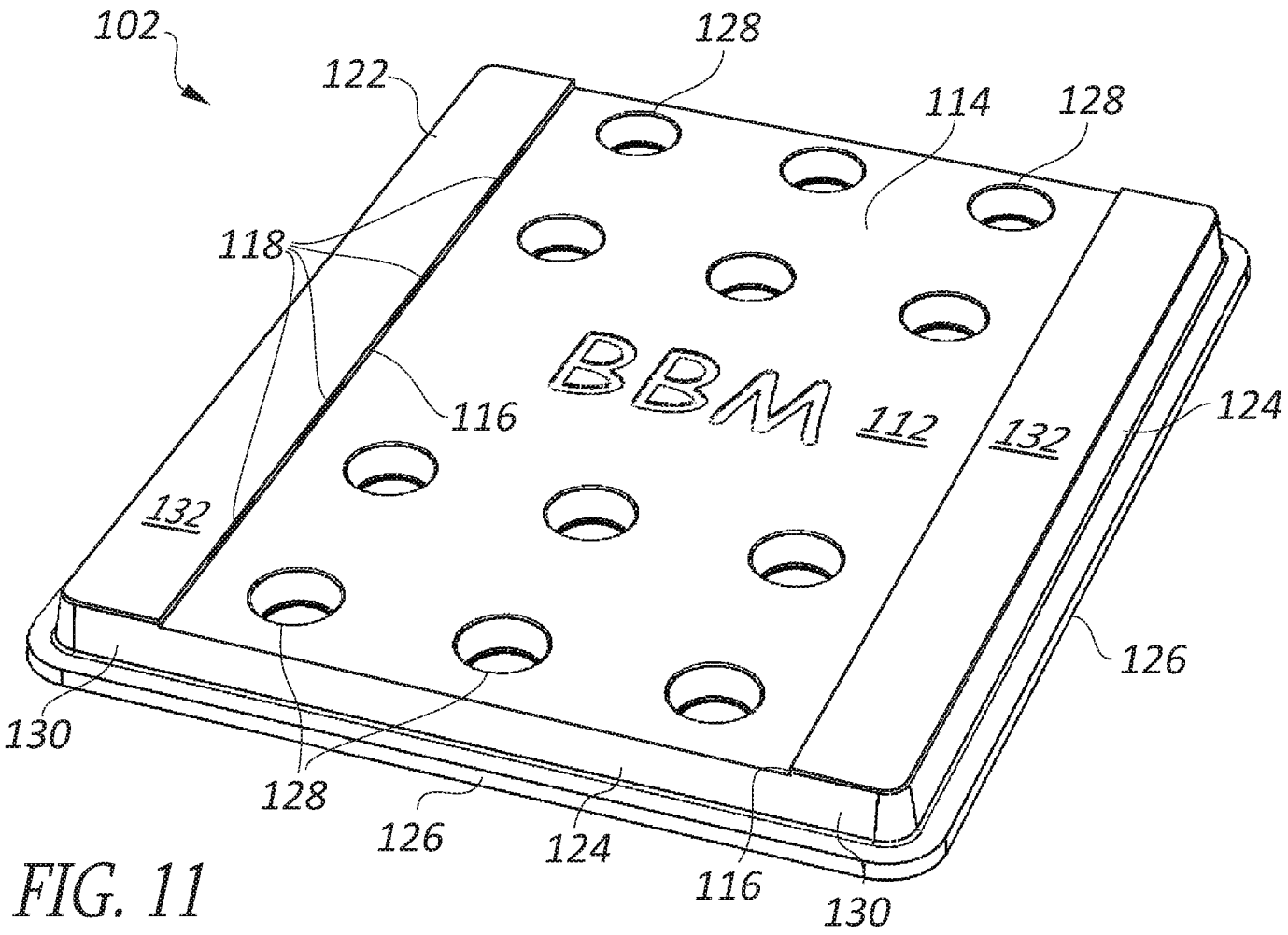
FIG. 11 is a perspective view of a recess member similar to that of FIGS. 9-10, showing the pour holes in the bottom of the recess in greater detail and also slot openings along the edges of the recess that receive corresponding tabs on the replaceable insert to lock the insert in position in the assembly.

FIGS. 9-11 show a replaceable wear insert assembly 100 in accordance with another embodiment of the invention. As can be seen, assembly 100 includes a recess member 102 and a replaceable insert member 104 having an upper playing surface 106 formed of a playing surface material (not shown in detail in FIGS. 9-10), such as synthetic turf or track material, similar to the embodiment described above.

As can also be seen in FIG. 10, the insert member 104 is relatively thin as compared with that in the embodiment described above, with the layer of playing surface material 106 being adhered or otherwise mounted atop a relatively thin panel 108 formed of a substantially rigid yet resiliently flexible material, such as a sheet of rigid ABS plastic material, for example. A series of laterally extending, lengthwise spaced tabs 110 are formed along the edges of the panel 108, that cooperate with corresponding slot openings in the recess member as will be described in greater detail below.

With further reference to FIG. 10 and also FIG. 11, it can be seen that the recess member includes a relatively shallow upper recess 112, formed by a generally horizontal wall 114 that engages and supports the panel 108 of the replaceable insert member, and generally vertical shoulder walls 116 that border the sides of the recess 112 and rise by a height corresponding generally to the thickness of the panel 108 of the insert member.

As can best be seen in FIG. 11, a series of slot openings 118 are formed in the edge walls 116 of the recess, that accommodate the tabs 110 along the edges of the panel 108 of the replaceable insert member 104. In order to install the replaceable insert member, therefore, the tabs 110 along one side of the insert member are inserted into the corresponding slot openings 118 of the recess member along one side of the assembly, and the insert member is then lowered towards the other side of the assembly in the direction indicated by arrow 120 in FIG. 10 As this is done, the operator bows the rigid, resiliently flexible panel 108 of the insert upwardly towards the middle, effectively shortening the distance between the opposite edges of the insert member, and then inserts the tabs 110 into the slot openings 118 of the second edge wall 116. Then, when released, the panel of the insert member 104 springs back to its planar configuration, resting flat atop the wall 114 of the recess 112 and extending the tabs 110 into slot openings 118 to lock the insert firmly in place so as to prevent it from shifting about during use. Removal is accomplished by pulling upwardly towards the middle at the ends of the panel 108 so as to bow the latter upwardly and retract the tabs 110 from the slot openings 118 along one edge, and then lifting and pulling the insert member out of the opposite edge of the recess 112. Installation and removal and replacement of the insert member can thus be performed in a rapid and efficient manner, with the insert members themselves having a durable and economical form of construction. The tabs/slots 110/118 of the illustrated embodiment provide an economical, convenient and durable form of connection between the recess member 102 and the replaceable insert member 104. However, it will be understood that other forms of connections or connector members may be used in some embodiments to join the two members.

Referring again to FIGS. 10 and 11, it can be seen that recess member 102 includes a base section 122 defined by depending side walls 124 extending downwardly about the perimeter of the recess member and an outwardly extending perimeter flange 126 along the bottom edges of the side walls. The base section 122 is formed of a comparatively thin, rigid material, such as molded ABS sheet material, for example, and thus forms a shell for example in an overturned tray with a hollow area beneath the wall 114 of the upper recess 112. One or more pour holes 128 are formed vertically through wall 114, through which concrete may be poured into the hollow interior of the shell formed by the base section, and additionally foam fill may be preinstalled in the form of blocks or "piers" in side areas 130 of the shell bordering the recess area.

To install the recess member 102, an excavation or other opening may be formed in the playing field and the recess member set on the substrate therein. The recess member can be adjusted in position to achieve the desired location, alignment and degree of level, the rigidity of the shell and the foam blocks or "piers" aiding in handling of the member as this is done. Once in position, soil or other material is backfilled over the base flange 126 and side walls 124, to roughly level with the upper surface of the insert member. Concrete may then be poured through openings 128 to fill the interior of the shell beneath wall 114, weighting the recess member and engaging the substrate so as to anchor it in place, and supporting the wall 114 of the recess against downward loading due to players treading on the upper surface of the insert member. Replaceable strips of synthetic turf material may then be adhered or otherwise mounted on horizontal surfaces 132 bordering the sides of the recess 112 atop the side areas 130 of the recess member 102 so as to form a synthetic playing surface that will lie generally level with that of the insert member 104. The insert member is then installed in the manner described above to complete the assembly.

As with the embodiment described above, one or more assemblies may be located in the pitching lane or in other high wear areas on or about a baseball or softball field, or in high-wear areas of other playing fields. Moreover, multiple assemblies may be installed in end-to-end relationship or other patterns to provide elongated or enlarged areas of replaceable wear surfaces, if desired.

Figure 12:
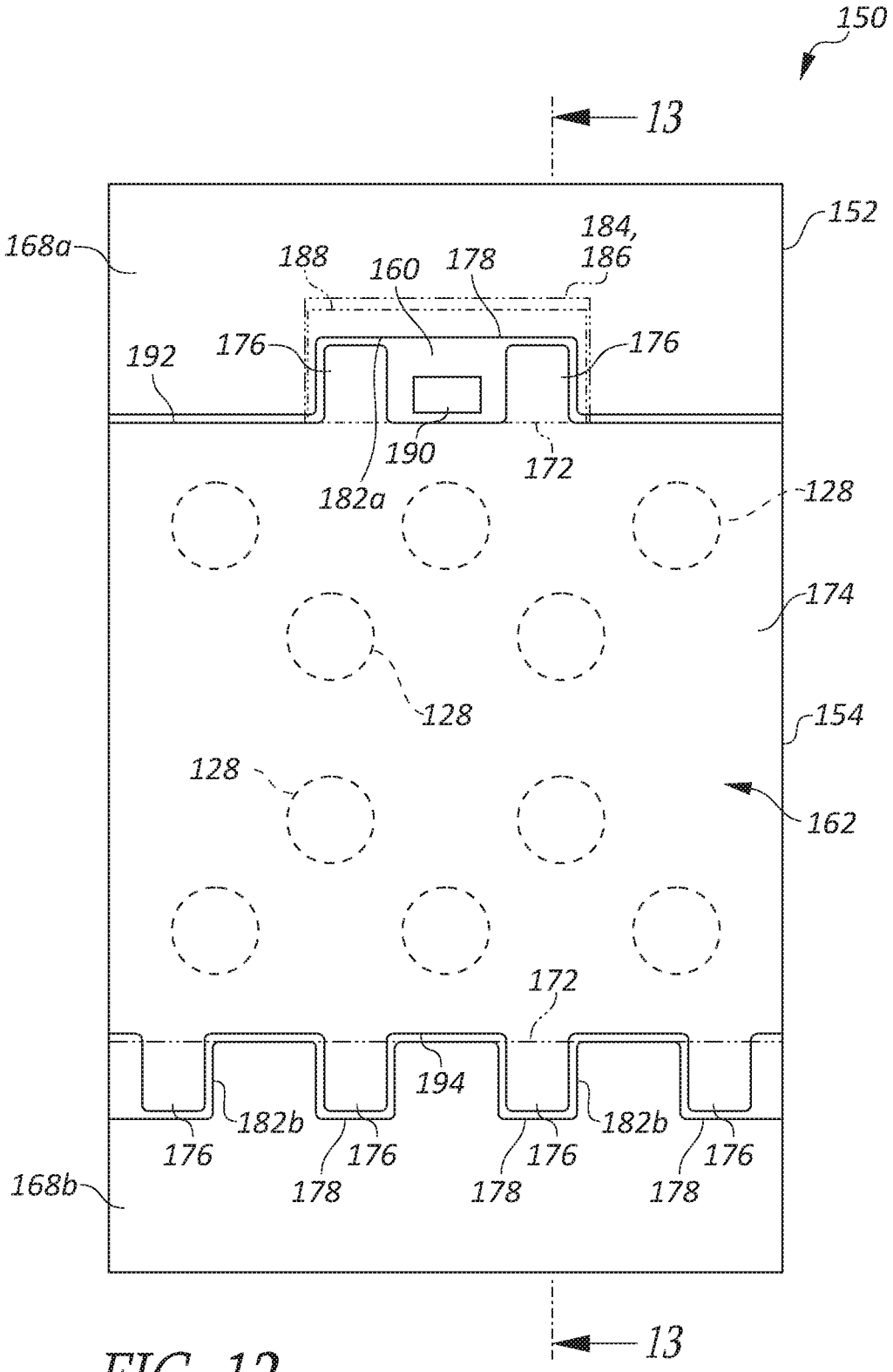
FIG. 12 is a top plan view of the wear insert assembly according to an embodiment, with the upper playing surface omitted in order to show underlying details.
Figure 13:
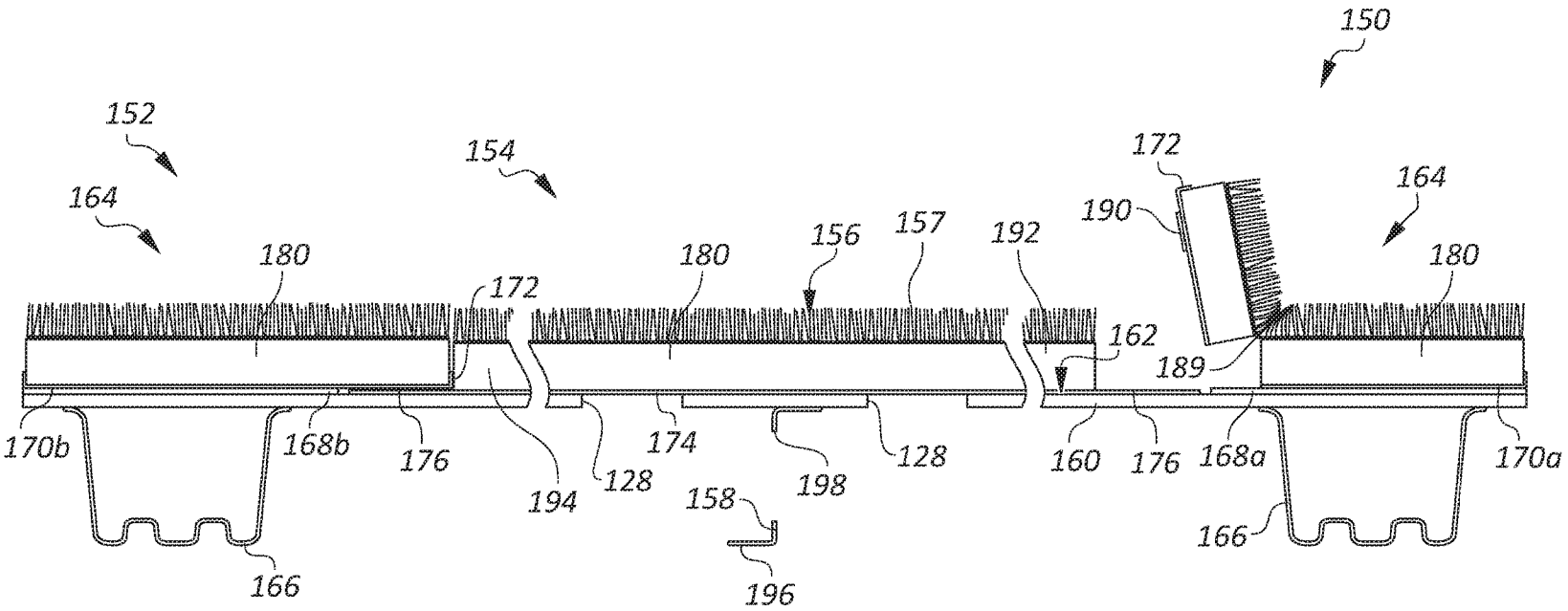
FIG. 13 is a side sectional view of the wear insert assembly of FIG. 12, as viewed along lines 13-13.
Figure 14:
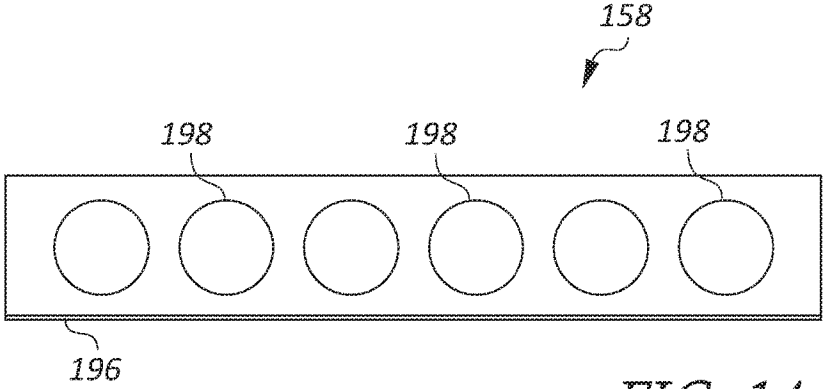
FIG. 14 is an end elevational view of an anchor member of the insert assembly of FIG. 12, according to an embodiment.

FIGS. 12-14 show a replaceable wear insert assembly 150 in accordance with a further embodiment of the invention. As shown, the wear insert assembly 150 includes a recess member 152 and a replaceable insert member 154 having an upper playing surface 156 formed of a playing surface material 157, such as synthetic turf or track material, similar to other embodiments described above. FIG. 12 is a top plan view of the wear insert assembly 150, with the upper playing surface omitted in order to show underlying details. FIG. 13 is a side sectional view of the wear insert assembly 150 as viewed along liens 13-13 of FIG. 12 and FIG. 14 is an end elevational view of an anchor member 158 of the recess member 152, as described in more detail below.

Referring to FIGS. 12 and 13, the recess member 152 includes a base substrate 160 with pour holes 128 (shown, in FIG. 12, in hidden lines), a recess 162 configured to receive the replaceable insert member 154, side areas 164, support piers 166, and anchor members 158. Slot plates 168 are attached to the upper surface of the base substrate 160 in positions corresponding to the side areas, and the side areas 164 are defined by shallow trays 170 attached to the upper surfaces of the slot plates 168. Inward facing rims 172 of the shallow trays and/or edges of the slot plates 168 define sidewalls of the recess 162. The shallow trays 170 and slot plates 168 are substantially coextensive with the base substrate 160 on three sides, at the respective ends of the base substrate. An inner surface of the recess 162 is defined by the upper face of the base substrate 160, on which the insert member is configured to rest during normal use. According to various embodiments, the recess 162 can have a depth of less than two inches, less than one inch, or less than one half inch.

The replaceable insert member 154 includes an insert substrate 174 and a plurality of tabs 176 that are configured to engage slots 178 formed in the slot plates 168, as described in more detail below. The tabs can be integral with the insert substrate 174, e.g., cut from a single sheet of material, or cast as a single piece, etc., or the tabs can be made separately and later attached to the insert substrate. According to an embodiment, the insert substrate and the tabs are cut from a single sheet of ABS plastic.

Resilient closed-cell foam cushion material 180 is positioned on the upper surface of the insert substrate 174 and in each of the shallow trays 170, and playing surface material 157 is attached to the top face of the foam cushion material.

The replaceable insert member 154 includes an insert substrate 174 and a plurality of tabs 176 that are configured to engage slots 178 formed in the slot plates 168, as described in more detail below. The tabs can be integral with the insert substrate, e.g., cut from a single sheet of material or cast as a single piece, etc., or the tabs can be made separately and later attached to the insert substrate. According to an embodiment, the insert substrate and the tabs are cut from a single sheet of ABS plastic.

Resilient closed-cell foam cushion material 180 is positioned on the upper surface of the insert substrate 174 and in each of shallow trays 170, and playing surface material 182 is attached to the top face of the foam cushion material.

Accordingly to an alternate embodiment, the shallow trays are omitted and a substantially planar upper plate is used with the resilient cushion material 180 positioned thereon. In that embodiment, the recess 162 is at least in part defined by an edge of the upper plate and an edge of the cushion material.

In FIG. 12, the foam cushion material and playing surface material are omitted to show the underlying structure. Likewise, the shallow trays are not shown in FIG. 12, although the positions of some of the features of the trays are shown in phantom lines to show relative positions, as described hereafter.

Notches 182 formed in the slot plates 168 define the sides of the slots 178. The shallow trays 170 are positioned over the slot plates 168 such that the inward facing rims 172 extends over the notches 182, bottom surfaces of the trays defining the upper parts of the slots 178, while the lower parts are defined by the upper surface of the base substrate 160.

The thickness and material of the base substrate 160 is selected to provide substantial rigidity to the recess member 152. According to an embodiment, the base substrate is made from ABS plastic, with a thickness of about 0.25 inches (about 6 mm). The thickness of the slot plates 168, which defines the height of the slots 178, is selected to be slightly greater than that of the tabs to permit the tabs to be moved into and out of the slots without undue difficulty. According to an embodiment, the slot plates have a thickness of about 0.090 inches 9 about 2.3 mm), while the tabs have a thickness of about 0.060 inches (about 1.5 mm).

In FIG. 12 it can be seen that a first slot plate 168*a* includes a single, relatively wide notch 182*a*, while a second slot plate 168*b* includes several narrower notches 182*b*. A first shallow tray 170*a*, positioned over the first slot plate 168*a*, comprises two segments, as shown in phantom lines in FIG. 12. A first tray segment 184 constitutes most of the first tray 170*a*, with a notch 186 positioned over the notch 182*a* of the first slot plate 168*a*. The first tray segment is immovably affixed to the first slot plate 168*a*. The second tray segment 188 is positioned in the notch 186 of the first segment 184, and is not affixed to the first slot plate.

Referring now to FIG. 13, the foam cushion material 180 that is positioned in the first tray 170*a* is cut to conform to the shapes of the first and second tray segments 184, 188, while the playing surface material is cut along the sides of the second segment, but no along the end, extending between the first and second segments of the first tray and holding them in their proper relative positions. The playing surface material or, in the case of a synthetic turf, the backing of the playing surface material, extending between the first and second segments, acts as a simple hinge, permitting a flap, including the second segment 188 to be lifted to expose the wide notch 182*a*. Hook and loop fasteners 190 positioned on the upper surface of the base substrate 160 and the underside of the second segment 188 hold the flap in place during normal operation.

The insert member 154 includes a plurality of tabs 176 that are positioned to be received into the slots 178. At a first end 192 of the insert member, two tabs 176 are positioned to engage the slot defined by the wide notch 182*a*, while tabs at the second end 194 are positioned to engage each of the slots defined by the narrower notches 182*b*.

To install or replace the replaceable insert member 154, a user holds the insert member at a shallow angle with the second end 194 positioned in the recess 162, while holding the first end 192 slightly elevated, and moves the insert member so that the tabs at the second end slide into the corresponding slots. While continuing to hold the first end elevated, the user pulls upward on the inward facing rim 172 of the second segments 188 of the first tray 170, separating the hook and loop fasteners 190 and rotating the second segment outward, as shown in FIG. 13. The user then allows the first end of the of the insert member 154 to drop into the recess, with the two tabs lying within the wide notch 182*a*. The user then drops the second segment back into place and presses downward to ensure that the hook and loop fasteners reengage securely.

According to an embodiment, the portion of the playing surface 156 defined by the upper surface of the recess member 152 is, at least in aggregate, substantially planar and parallel with a plane defined by the upper surface of the base substrate 160. Likewise, the portion of the playing surface 156 defined by the upper surface of the insert member 154 is, at least in aggregate, also substantially planar and, while positioned within the recess, parallel with the plane defined by the upper surface base substrate 160.

The base substrate 160 includes a plurality of pour holes 128 positioned to permit the introduction of concrete into the space between the base substrate 160 and the ground below. Support piers 166 are positioned on the underside of the base substrate 160, extending downward, and an anchor member 158 is also positioned on the underside of the base substrate 160. The anchor member has a flange 196 that is positioned to lie in a common plane with the bottom surfaces of the support piers. The anchor member also includes a plurality of flow holes 198—see FIG. 14—positioned to permit concrete to pass through as it is poured and to be engaged by the concrete as it hardens.

The support piers 166 and anchor members 158 serve to stiffen the base substrate 160, and act as spacers to position the recess and playing surface 156 at a desired level and orientation, relative to the ground surface, during installation. The support piers can also serve as partial barriers to limit and/or channel the flow of concrete during installation.

Depending upon the configuration of the assembly, the numbers, sizes and orientations of support piers and anchor members can vary. For example, the assembly 150 can include a socket configured to receive a pitching rubber. In such a case, the arrangement of support piers, anchor members, pour holes, etc. are positioned so as not to interfere with the socket. Furthermore, the replaceable insert member can be provided with an aperture through which the pitching rubber extends.

During installation of the assembly 150, an installer prepares a trench or excavation of the appropriate depth and with a substantially smooth and level bottom, or ground surface. The replaceable wear insert assembly 150 is positioned in the trench on the ground surface in the proper field position with the bottom surfaces of the support piers and the flange 196 of the anchor member resting on the ground surface of the trench, and the playing surface at the same level as the surrounding playing field. Concrete is introduced via the pour holes 128, and caused to spread out under the assembly and flow through the flow holes 198 of the anchor members, to substantially fill the space between the base substrate and the bottom of the trench. The trench is backfilled around the assembly, and the playing surface of the playing field is brought into abutment with the perimeter of the assembly 150. Once the concrete has cured, the replaceable insert member 154 is installed as previously described and the field is ready for use.

Components of the assembly 150, including the base substrate, slot plate 168, trays 170, support piers 166 and anchor member 158 are preferably made of a material that is sufficiently strong and durable as to tolerate the impacts and weight loads that are typical on such playing fields. According to an embodiment, these components are made of ABS plastic. In addition to its strength and durability, ABS plastic is attractive from a manufacturing point of view, inasmuch as it is relatively simple to form, using machining processes, heat forming, solvent welding, etc.

In the embodiment shown in FIGS. 12-14, the support piers 166, slot plates 168, and tray 170 are separate elements made of ABS plastic that are each affixed to the base substrate via solvent welding. According to other embodiments, many of the components are formed together using one or a combination of various molding and/or machining processes. While the inventors have found ABS plastic to be satisfactory for the purpose, other materials are also contemplated.

The assembly 150 shown in the embodiment of FIGS. 12-14 is configured to be positioned in a playing field with similar assemblies arranged on either side. Accordingly, the recess 162 and replaceable insert member 154 are shown, particularly as viewed in FIG. 12, as being coextensive with, i.e., extending the full width of the assembly 150, while the recess is defined on the ends, only. The sides of the recess are not enclosed, but are defined only by the edges of the assembly. Where an assembly is configured to be positioned at the end of a row of such assemblies, the recess 162 and insert member 154 can be made to occupy less than the full width, so that it is enclosed on three of four sides. One example of this is shown in FIG. 15.

Figure 15:
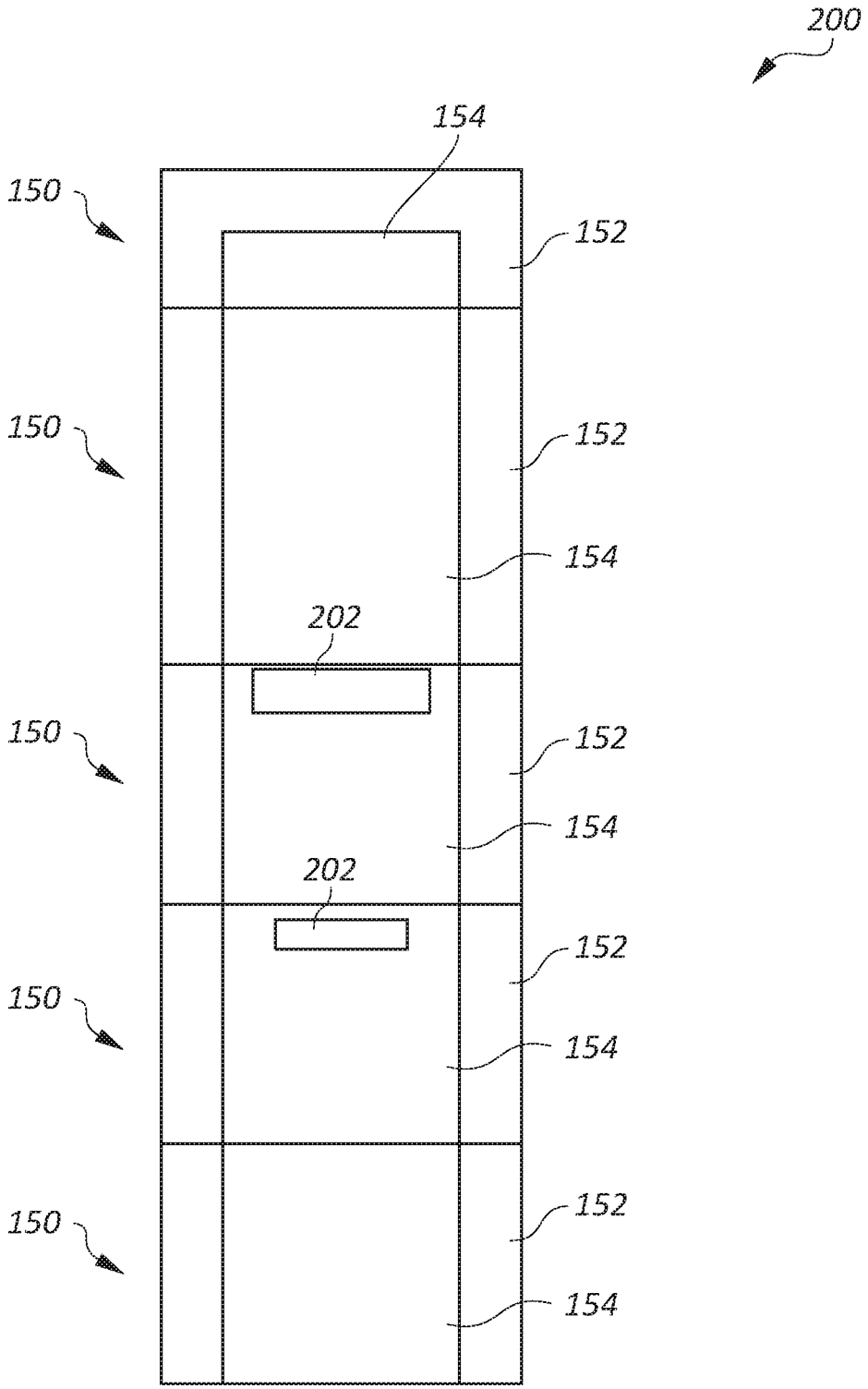
FIG. 15 is a plan view of a portion of a playing field, according to an embodiment, including a plurality of replaceable wear insert assemblies, arranged along a line extending between home base and second base of the field.

FIG. 15 is a plan view of a pitch extension 200 of a playing field, according to an embodiment, that includes a plurality of replaceable wear insert assemblies 150, arranged along a line extending between home base and second base of the field. Each assembly includes a recess member 152 and a replaceable insert member 154. Two pitching rubber sockets 202 are provided, a first at 40 feet from home plate, which is a distance commonly used in youth league competition, and a second at 43 feet, a distance commonly used in collegiate competition. In practice, a filler plug is provided for each pitching rubber socket 202, sized to fit snugly into the respective socket, with a piece of the playing surface material attached to its upper surface, sized so that when positioned within the socket, the upper surface is flush with the surface of the surrounding insert member.

There are a number of different pitching distances that are in common use, in addition to those shown in FIG. 15, depending upon the league, age, and gender of the competitors. Embodiments are contemplated in which pitch extensions are provided that include pitching rubber sockets positioned at any combination of pitching distances, whether in common use or not.

Where a claim limitation recites a structure or element as an object of the limitation, that structure itself is not an element of the claim, but is a modifier of the subject. For example, in a limitation that recites "a spacing member coupled to the recess member and configured to hold the recess member a distance from a ground surface," the ground surface is not an element of the claim, but instead serves to define the scope and meaning of the term spacing member. Additionally, subsequent limitations or claims that recite or characterize additional elements relative to the ground surface do not render the ground surface an element of the claim. Only in a claim that recites the ground surface itself as the subject of a claim limitation does the ground surface become an element of that claim.

While a number of embodiments are shown and described, the claims are not limited by or to the disclosed embodiments, nor any combination of disclosed features, but only by the language thereof.

Ordinal numbers, e.g., first, second, third, etc., are used in the claims according to conventional claim practice, i.e., for the purpose of clearly distinguishing between claimed elements or features thereof. The use of such numbers does not suggest any other relationship, e.g., order of operation or relative position of such elements, etc. Furthermore, an ordinal number used to refer to an element in a claim does not necessarily correlate to a number used in the specification to refer to an element of a disclosed embodiment on which that claim reads, nor to numbers used in unrelated claims to designate similar elements or features. The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

It will be understood that the scope of the appended claims should not be limited by particular embodiments set forth herein, but should be construed in a manner consistent with the specification as a whole.

What is claimed is:

1. An assembly comprising:

a recess member, including:

a base substrate having a plurality of pour holes, first and second side areas positioned at respective ends of the base substrate, each having means for supporting a playing surface coupled to an upper face of the base substrate and an upper playing surface formed of a playing surface material coupled to the support means, a recess configured to receive a removable insert member, a bottom surface of the recess being defined by the upper face of the base substrate, and edges of the recess being defined by edges of the support means of the first and second side areas, a plurality of support piers coupled to a lower face of the support base; and a removable insert member configured to be received by the recess member and to rest on the bottom surface of the recess, the removable insert member having an upper playing surface formed of a playing surface material.

2. The assembly of claim 1, wherein the removable insert member includes an insert substrate to which the upper playing surface of the removable insert member is coupled.

3. The assembly of claim 2, wherein the recess member includes:

a plurality of slot plates attached to the upper surface of the base substrate in positions corresponding to the side areas of the recess member, each defining one or more slots between the means for supporting a playing surface and the upper surface of the base substrate; and a plurality of tabs coupled to the insert substrate and configured to engage the slots defined by the slot plates.

4. The assembly of claim 1, wherein the removable insert member includes:

an anchor member positioned on the lower face of the base substrate, the anchor member including:

a flange positioned to lie in a common plane with bottom surfaces of the support piers; and a plurality of flow holes extending through the anchor member.

* * * * *